US009110488B2

(12) United States Patent
Hunter et al.

(10) Patent No.: US 9,110,488 B2
(45) Date of Patent: Aug. 18, 2015

(54) WIDE-BANDWIDTH LINEAR REGULATOR

(75) Inventors: Bradford L. Hunter, South Burlington, VT (US); Todd M. Rasmus, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 143 days.

(21) Appl. No.: 13/154,840

(22) Filed: Jun. 7, 2011

(65) Prior Publication Data

US 2012/0313597 A1 Dec. 13, 2012

(51) Int. Cl.

| | |
|---|---|
| ***G05F 1/00*** | (2006.01) |
| ***G05F 1/575*** | (2006.01) |
| *G05F 1/565* | (2006.01) |
| *G05F 1/56* | (2006.01) |

(52) U.S. Cl.
CPC .. *G05F 1/575* (2013.01); *G05F 1/56* (2013.01)

(58) Field of Classification Search
CPC ..... G05F 1/575; G05F 1/565; G05F 1/56; G05F 1/563
USPC ..... 323/273, 275, 280
See application file for complete search history.

(56) References Cited

U.S. PATENT DOCUMENTS

| | | | | |
|---|---|---|---|---|
| 5,191,278 | A * | 3/1993 | Carpenter | 323/280 |
| 6,809,504 | B2 | 10/2004 | Tang et al. | |
| 6,909,265 | B2 | 6/2005 | Tang | |
| 7,193,453 | B2 | 3/2007 | Wei et al. | |
| 7,365,581 | B2 | 4/2008 | Shi et al. | |
| 7,372,382 | B2 | 5/2008 | Hazucha et al. | |
| 7,402,985 | B2 | 7/2008 | Zlatkovic | |
| 7,679,347 | B2 | 3/2010 | He et al. | |
| 7,760,525 | B2 | 7/2010 | Sutardja | |
| 2004/0104711 | A1 * | 6/2004 | Scoones et al. | 323/280 |
| 2005/0134389 | A1 * | 6/2005 | Scherrer et al. | 330/310 |
| 2008/0174289 | A1 * | 7/2008 | Gurcan et al. | 323/280 |

* cited by examiner

*Primary Examiner* — Adolf Berhane
*Assistant Examiner* — Henry Lee, III
(74) *Attorney, Agent, or Firm* — Edward J. Lenart; Joseph Petrokaitis; Kennedy Lenart Spraggins LLP

(57) ABSTRACT

A linear regulator and a method of regulating a supply voltage are provided. Embodiments include a linear regulator with a first feedback loop and a second feedback loop. The first feedback loop is characterized by a first bandwidth and a first gain. The first feedback loop includes a first amplifier characterized by an output impedance which is significantly reduced in order to maximize the bandwidth of the first feedback loop when driving the capacitance of a control input of a series pass element. The second feedback loop is characterized by a second bandwidth and a second gain. The second feedback loop includes a second amplifier that controls the current in the first amplifier in the first feedback loop.

12 Claims, 8 Drawing Sheets

WIDE-BANDWIDTH LINEAR REGULATOR

BACKGROUND OF THE INVENTION

1. Field of the Invention

The field of the invention is data processing, or, more specifically, a wide-bandwidth linear regulator and a method of regulating a power supply.

2. Description of Related Art

A voltage regulator is an electrical circuit designed to maintain a constant voltage level at its output even as operating conditions change over time. Every electronic circuit is designed to operate off of some supply voltage, which is usually desired to be constant. A voltage regulator provides this constant DC output voltage and contains circuitry that continuously holds the output voltage at the desired value regardless of changes in load current or input voltage (this assumes that the load current and input voltage are within the specified operating range for the regulator). We address the issue of voltage regulation, specifically, on-chip regulation of potentially noisy external power supplies to create a high DC accuracy, low AC noise voltage level that is used to power some local circuitry. Maintaining accurate voltage regulation is particularly challenging when the load current variations are sudden and extreme, e.g. minimum load to maximum load demand in a short period of time. Such sudden and extreme variations in load current can occur in applications in which portions of the circuitry being powered by the regulator switches from an idle state to a state with high activity factor (maximum workload).

Linear regulators are the most commonly used voltage regulator type in integrated circuits (ICs) and have a number of advantages. They can be integrated, requiring no off-chip components such as inductors. Unlike switching types, linear regulators generate no inherent ripple of their own, so they can produce a very "clean" DC output voltage, achieving low noise levels with minimal overhead (cost). Typically, a linear regulator operates by modulating the voltage drop across a series pass element, which can be modeled as a voltage-controlled resistance. The control circuitry monitors (senses) the output voltage. If the output voltage is lower than desired, a voltage is applied to the series pass element which decreases its resistance; since less voltage is dropped across the series pass element, the output voltage rises. Similarly, if the output voltage is higher than desired, the resistance of the series pass element is increased, so more voltage is dropped across the series pass element, and the output voltage falls. Since the output voltage correction is achieved with a feedback loop, some type of compensation is required to assure loop stability which can slow the feedback response of the regulator. Hence, any linear regulator requires a finite amount of time to correct the output voltage after a change in load current demand. This "time lag" defines the characteristic called transient response, which may not be fast enough for applications with sudden and extreme load current variations, such as the circuit application referenced above. To minimize this time lag, generally the linear regulator's bandwidth is increased. However, the need to maintain adequate loop stability (phase margin) limits the achievable bandwidth of most linear regulators. Filtering of regulated voltage domains with decoupling networks and parasitic device capacitances form time constants called 'poles' which cause accumulated phase shift in the regulator's open loop response. Such accumulated phase shift in the open loop can cause ringing or even oscillation at the linear regulator's output as the net phase approaches 180 degrees. Hence, to obtain both stability and fast transient response, the linear regulator's topological structure must provide a means to mitigate the problematic accumulation phase shift in the regulator's feedback loop when the open loop gain is greater than unity. Otherwise, the feedback error signal will become regenerative and cause instability in the loop.

To illustrate this point, FIG. 1 sets forth a Bode diagram illustrating frequency and phase response of an example linear regulator illustrated in FIG. 2. The example linear regulator of FIG. 2 includes a series pass element (230), a capacitance load element (220), a resistance load element (222), and an amplifier (228) with an input gate impedance (232). According to first-order principles, those skilled in the art will understand that a first pole (120) and a second pole (122) are formed in the feedback loop. The first pole (120) is formed due primarily to the impedance of the load of the regulator of FIG. 2, specifically the load capacitance element (220) and the load resistance element (222). The second pole (122) is formed due to the output impedance (226) of the amplifier (228) and the input gate capacitance (232) of the series pass element (230). Those skilled in the art will further understand that in the frequency domain, each pole will eventually contribute 90 degrees of phase shift to the open loop phase response. In order to maintain the unconditional stability of the negative feedback loop and satisfy the stability criteria, the open loop gain must be reduced below unity prior to the accumulated open loop phase reaching 180 degrees of phase shift. If the load capacitance element (220) is large, the first pole (120) will generally be low in frequency. However, any change in the load resistance element (222) will shift the first pole (120) up or down in frequency. Likewise, if the gate capacitance element (232) is large because the series pass element (230) is large, the second pole (122) will be generally be low in frequency. However, any change in the output impedance (226) will shift the second pole (122) up or down in frequency. If both the first pole (120) and the second pole (122) form essentially at the same frequency, the phase contribution from each will quickly accumulate phase shift in the open loop response. Furthermore, as illustrated in FIG. 1, if the open loop gain has not been attenuated to less than unity prior to the open loop phase accumulation reaching 180 degrees, loop oscillation will result.

SUMMARY OF THE INVENTION

A linear regulator and a method of regulating a supply voltage are provided. Embodiments include a linear regulator with a first feedback loop and a second feedback loop. The first feedback loop is characterized by a first bandwidth and a first gain. The first feedback loop includes a first amplifier characterized by an output impedance which is significantly reduced in order to maximize the bandwidth of the first feedback loop when driving the capacitance of a control input of a series pass element. The second feedback loop is characterized by a second bandwidth and a second gain. The second feedback loop includes a second amplifier that controls the current in the first amplifier in the first feedback loop.

The foregoing and other objects, features and advantages of the invention will be apparent from the following more particular descriptions of exemplary embodiments of the invention as illustrated in the accompanying drawings wherein like reference numbers generally represent like parts of exemplary embodiments of the invention.

DETAILED DESCRIPTION OF EXEMPLARY EMBODIMENTS

Figure 1:
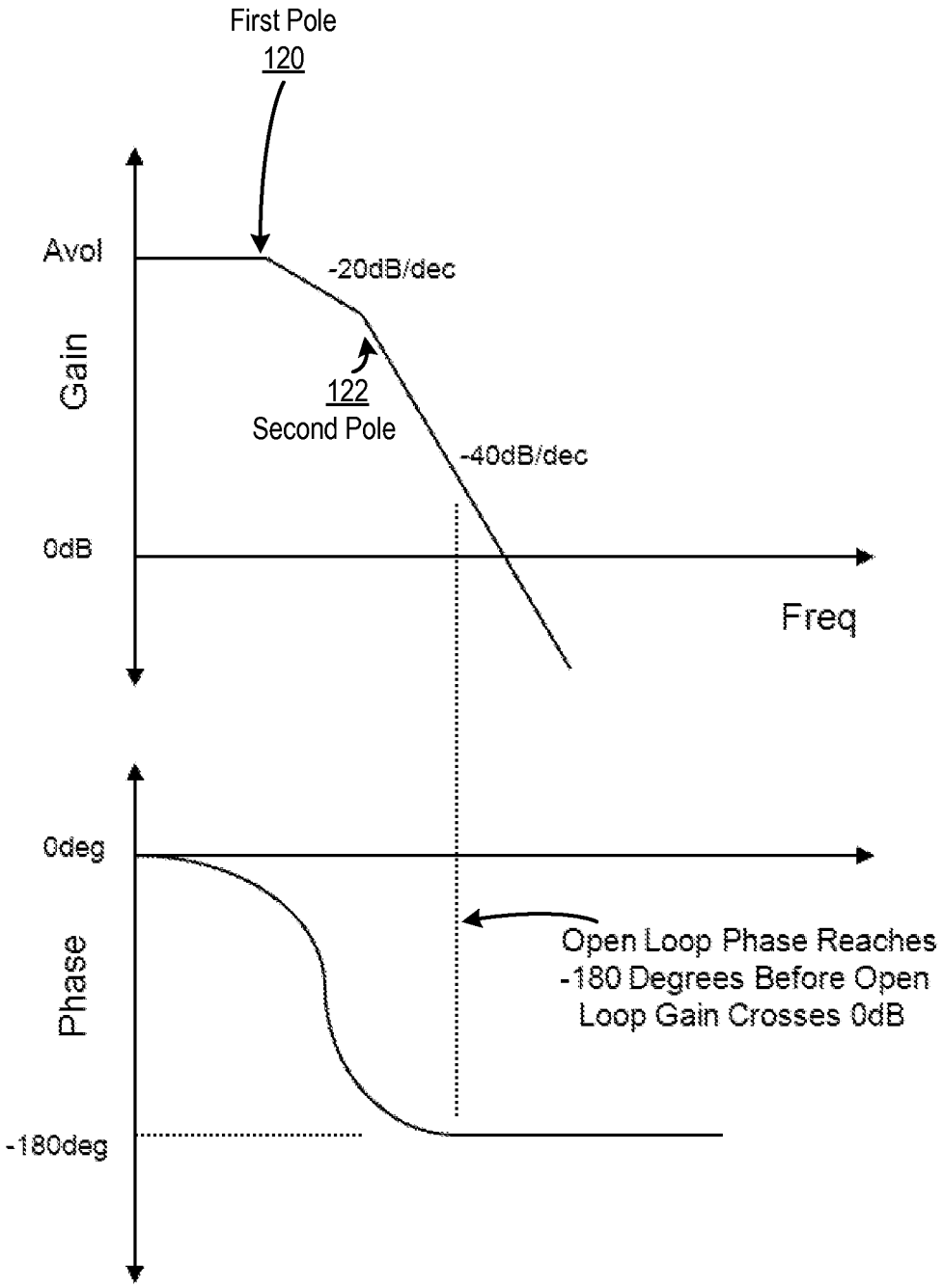
FIG. 1 sets forth a bode diagram illustrating frequency and phase response of an example regulator illustrated in FIG. 2.
Figure 2:
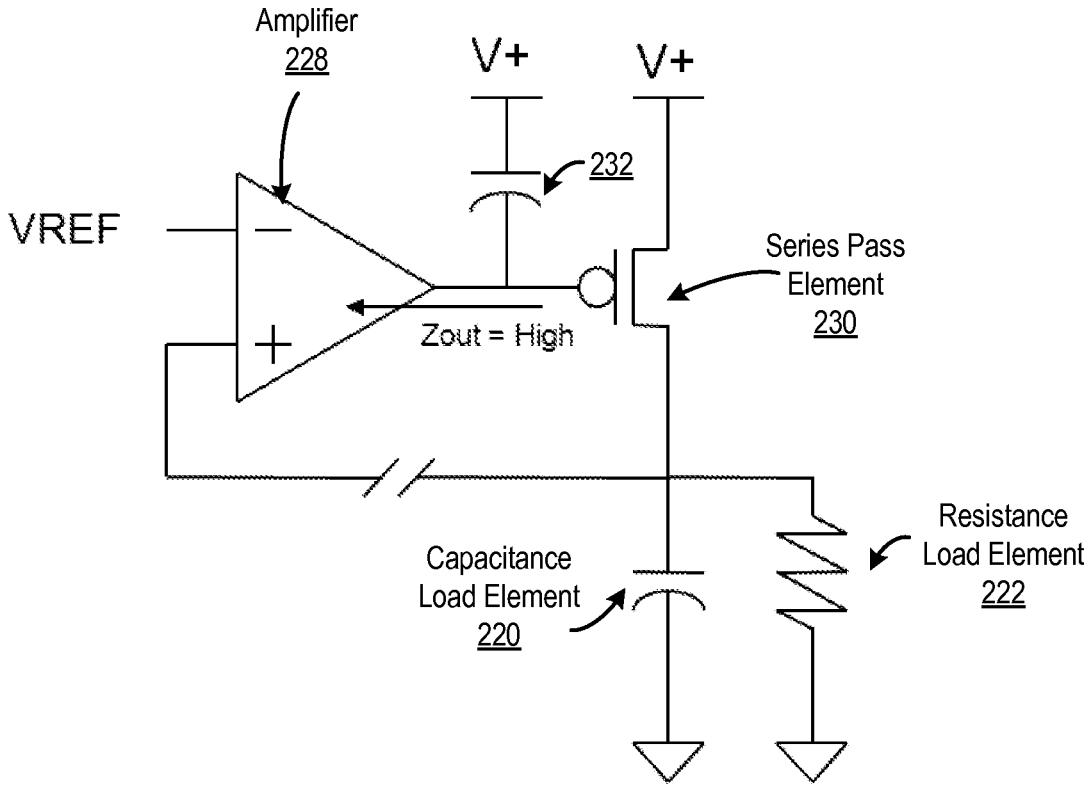
FIG. 2 sets forth an example regulator found in prior art.
Figure 3:
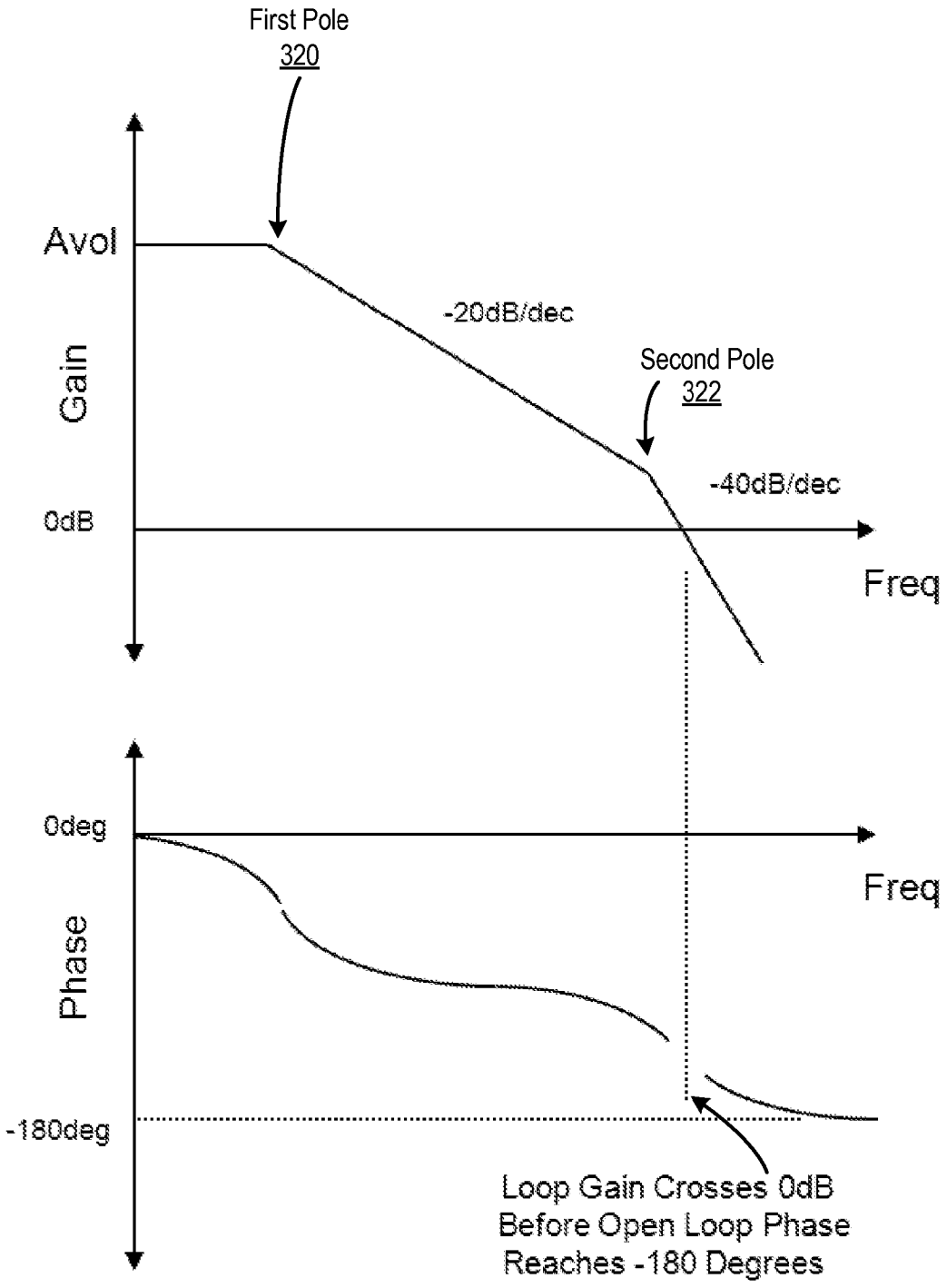
FIG. 3 sets forth a bode diagram illustrating frequency and phase response of an example linear regulator illustrated in FIG. 4, according to embodiments of the present invention.
Figure 4:
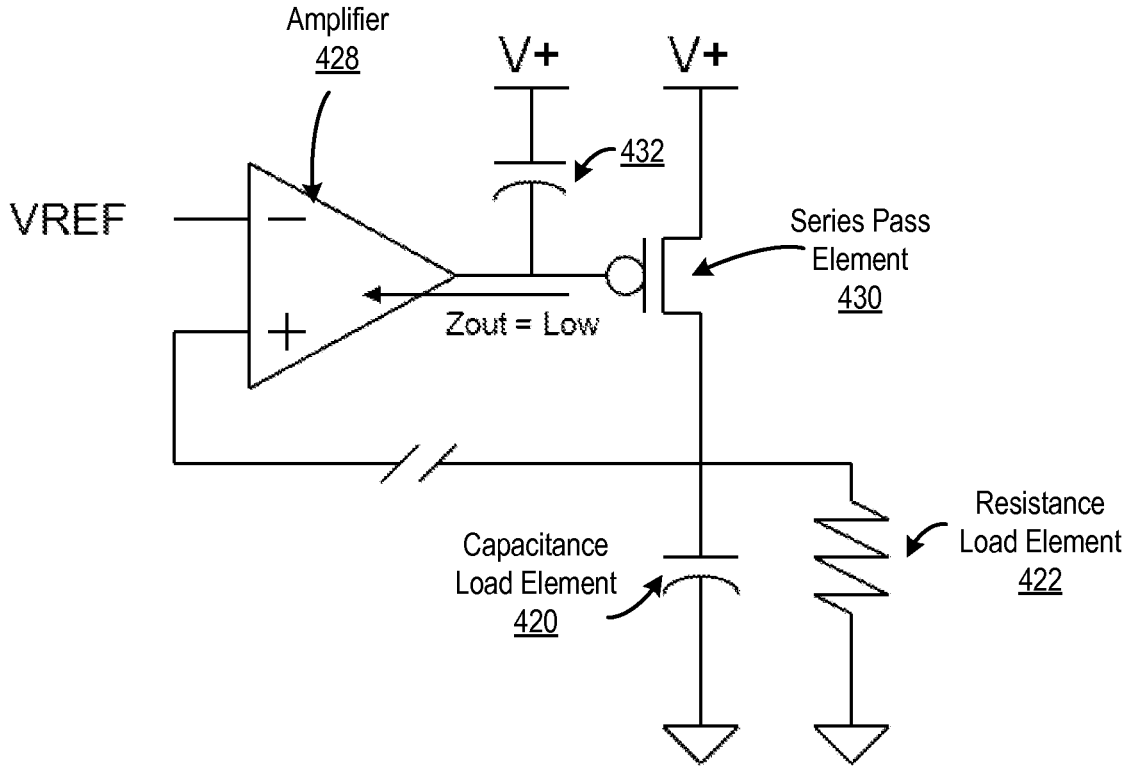
FIG. 4 sets forth an example linear regulator with one feedback loop according to embodiments of the present invention.

Examples of linear regulators and methods of regulating a power supply in accordance with the present invention are described with reference to the accompanying drawings, beginning with FIG. 3. FIG. 3 sets forth a bode diagram illustrating frequency and phase response of an example linear regulator illustrated in FIG. 4, according to embodiments of the present invention. The example linear regulator of FIG. 4 includes a series pass element (430), a capacitance load element (420), a resistance load element (422), and an amplifier (428) with an input gate impedance (432). As in FIGS. 1-2, a first pole (320) is formed due primarily to the impedance of the load of the regulator of FIG. 4, specifically the load capacitance element (420) and load resistance element (422). The second pole (322) is formed due to the output impedance (426) of the amplifier (428) and the input gate capacitance (432) of the series pass element (430). In order to maintain the unconditional stability of the negative feedback loop and satisfy the stability criteria, the open loop gain must be reduced below unity prior to the accumulated open loop phase reaching 180 degrees of phase shift. Hence, it is very desirable to those skilled in the art to maintain large frequency separation between the first pole (320) and the second pole (322) for stable operation of the feedback loop as illustrated in FIG. 3. Hence, to maintain frequency separation between the first pole (320) and the second pole (322), the amplifier (428) is required to have a low output impedance as shown in FIG. 4.

While stable feedback loop operation is desirable, however it is not the only design criteria to be met in linear regulator design. The linear regulator must also regulate the output voltage with a high degree of accuracy. In principle, this often requires the amplifier (428) in FIG. 4 to have a high output impedance to achieve high gain in practice (given an amplifier gain (Av) with a gain equation of Av=gm*Zout where gm is the amplifier transconductance), otherwise inaccuracies in the form of gain error will form at the regulator's output due to the low loop gain. Obtaining both high accuracy and feedback stability is very difficult because the first requires the amplifier (428) to have a high output impedance, while the second requires the amplifier to have a low output impedance if the gate capacitance element (432) is large.

To obtain the fast transient response required to regulate a dynamically changing load, high unity gain bandwidth in the open loop gain response is usually desirable. To achieve such high bandwidth and feedback stability is difficult because the open loop gain response crosses below unity at a much higher frequency, while the phase shift in the loop can accumulate to 180 degrees prior to the unity gain crossover point. Due to the illustrations of FIGS. 3 and 4, readers of skill in the art will understand it is very desirable to maintain large frequency separation between the first pole (320) and the second pole (322) to obtain feedback stability, regulation accuracy, and fast transient loop response.

Figure 5:
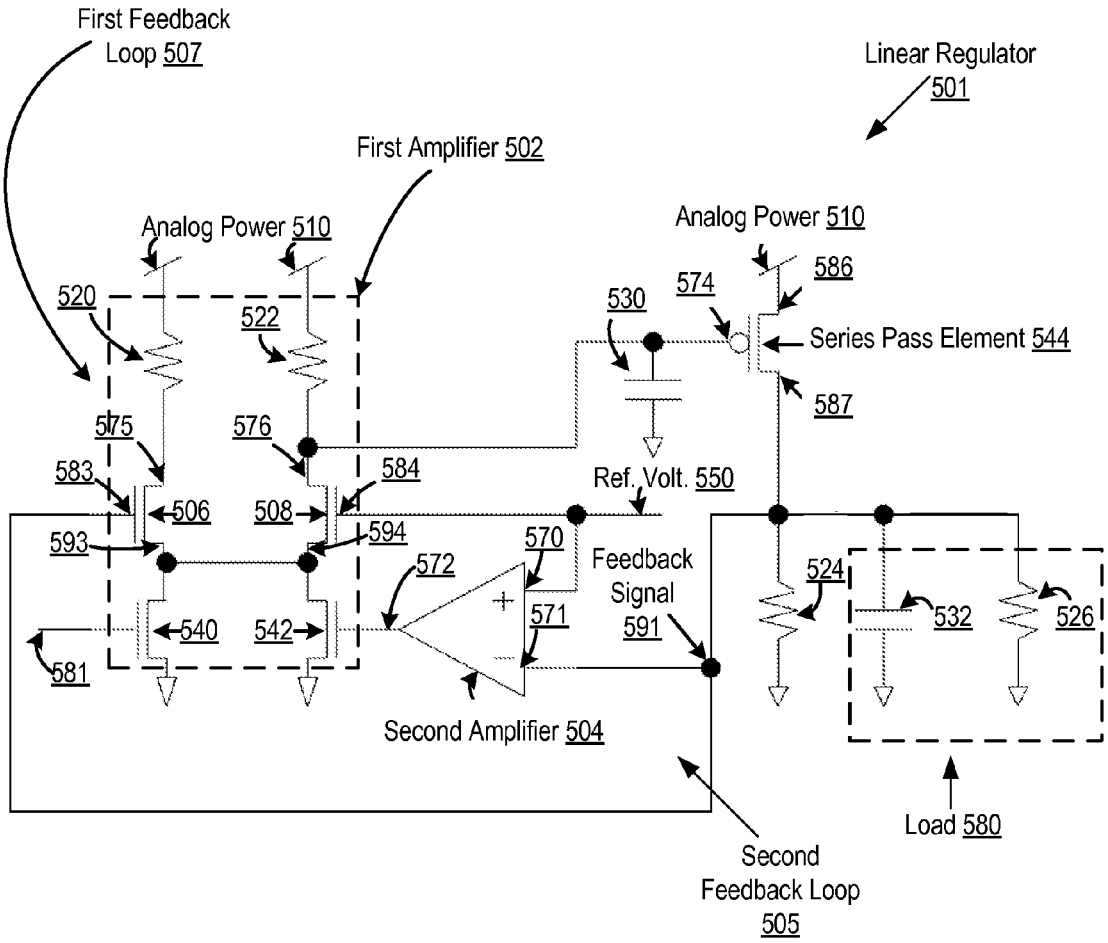
FIG. 5 sets forth another example linear regulator with two feedback loops according to embodiments of the present invention.

In order to obtain a linear regulator with feedback stability, regulation accuracy, and fast transient response, a linear regulator with two feedback loops is provided. FIG. 5 sets forth a diagram of an example linear regulator (501) with two feedback loops according to embodiments of the present invention. The linear regulator (501) of FIG. 5 includes a series pass element (544) with an input (586) coupled to analog power (510) and a regulated output (587) coupled to a load (580) represented as a load capacitor (532) and a load resistor (526). The output (587) of the series pass element (544) is also coupled to a minimum load resistor (524). Although the load (580) is represented as the load capacitor (532) and the load resistor (526), any number and type of electrical components may be used to implement a load according to embodiments of the present invention.

The linear regulator (501) of FIG. 5 includes a first feedback loop (507) comprising a first amplifier (502), a second feedback loop (505) comprising a second amplifier (504), and a series pass element (544), all which act together to regulate the voltage level at the regulated output (587) of the series pass element (544). Regulating the voltage level at the regulated output (587) includes the first feedback loop (507) and second feedback loop (505) of FIG. 5 maintaining a voltage level at the regulated output (587) that substantially matches a voltage level at a reference voltage (550).

The first feedback loop (507) of FIG. 5 is comprised of a low gain, high bandwidth differential first amplifier (502), and the series pass element (544). The first amplifier (502) comprises a first transistor (506), a second transistor (508), load resistors (520, 522), and biasing transistors (540, 542). The first transistor (506) and the second transistor (508) are configured as a differential pair, and the biasing transistors (540, 542) are configured as current sources biasing current for the first transistor (506) and the second transistor (508). The biasing transistor (540) is driven by a fixed bias voltage (581) to provide a static current bias to the first transistor (506) and the second transistor (508). The biasing transistor (542) is driven by a control signal from the output (572) of the second amplifier (504). In the example of FIG. 5, the first transistor (506), the second transistor (508), and the pair of biasing transistors (540, 542) are n-channel metal-oxide-semiconductor field-effect transistors (MOSFETs). However, bipolar junction transistors, junction gate field effect transistors, and any other type of transistor that occurs to one of skill in the art, may be used in place of the transistors of FIG. 1 according to embodiments of the present invention.

In the first feedback loop (507), a control input (583) of the first transistor (506) is coupled to the regulated output (587) of the series pass element (544). A second input (593) of the first transistor (506) is coupled to the outputs of the biasing transistors (540, 542). An output (575) of the first transistor (506) is coupled to the analog power (510) through a load resistor (520).

In the first feedback loop (507), a control input (584) of the second transistor (508) is coupled to the reference voltage (550). A second input (594) of the second transistor (508) is coupled to the outputs of the biasing transistors (540, 542)

and to the second input (593) of the first transistor (506). An output (576) of the second transistor (508) is coupled to the analog power (510) through a load resistor (522). The output (576) of the second transistor (508) is also coupled to the control input (574) of the series pass element (544). The first amplifier (502) is driven by the reference voltage (550) and a feedback signal (591). The first amplifier (502) drives a control signal onto the control input (574) of the series pass element (544) of the linear regulator (501).

The second feedback loop (505) in the example of FIG. 5 is comprised of a high gain, low bandwidth second amplifier (504), the biasing transistor (542), the first amplifier (502), and the series pass element (544). An non-inverting input (570) of the second amplifier (504) is coupled to the reference voltage (550). An inverting input (571) of the second amplifier (504) is coupled to the regulated output (587) of the series pass element (544). An output (572) of the second amplifier (504) is coupled to an input to the first amplifier (502). The second amplifier (504) is driven by the reference voltage (550) on the non-inverting input (570) and by the feedback signal (591) on the inverting input (571) of the second amplifier (504).

The operation of the first amplifier (502) is also controlled in part by the second feedback loop (505). In particular, the voltage level at the output (572) of the second amplifier (504) drives the biasing transistor (542) of the first amplifier (502). The second amplifier (504) serves to dynamically control the current biasing of the first amplifier (502) in order to force the voltage impressed across load resistors (520, 522), and hence the voltage levels at the outputs (575, 576) of the first transistor (506) and the second transistor (508), to be essentially the same. An imbalance between the voltage levels at the outputs (575, 576) of the first transistor (506) and the second transistor (508) is created when the first feedback loop (507) requires the control input (574) of series pass element (544) to change due to a change in current demand by the load (580). That is, when the current demand by the load (580) changes, the first amplifier (502) of first feedback loop (507) acts to quickly change the control input (574) of the series pass element (544) in order to increase or decrease the current being supplied to the load (580). Thereafter, the second amplifier (504) of second feedback loop (505) acts more slowly, but with high gain, to balance the voltages across the load resistors (520, 522), and hence the outputs (575, 576) of the first transistor (506) and the second transistor (508), by modulating the current in the biasing transistor (542). Thus, the second feedback loop (505) eventually forces the voltages of outputs (575, 576) of the first transistor (506) and second transistor (508) to be effectively the same potential. The extent to which the second feedback loop (505) locks the output voltage (587) of the linear regulator (501) to the reference voltage (550) is determined by the voltage difference between outputs (575, 576) of the first transistor (506) and second transistor (508) divided by the voltage gain of the first amplifier (502).

Figure 6:
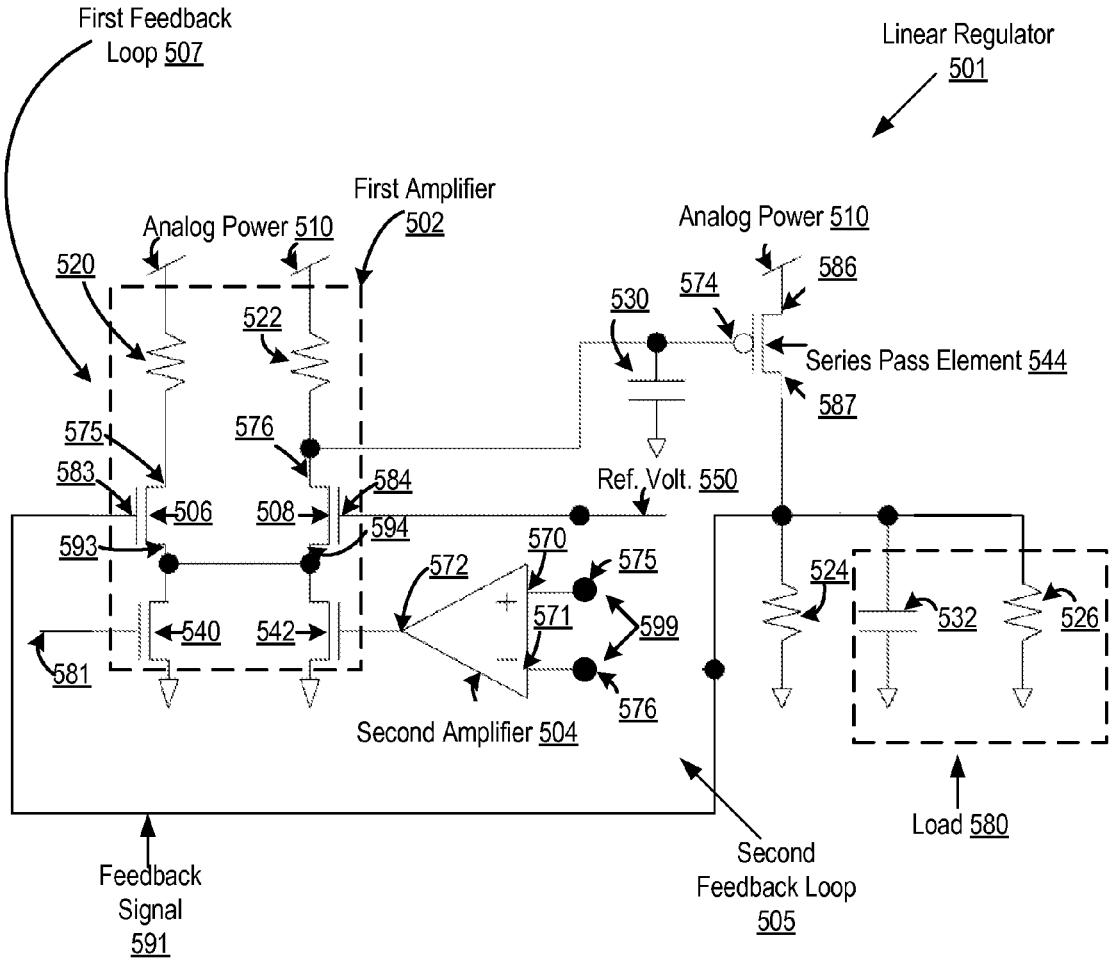
FIG. 6 sets forth another example linear regulator with two feedback loops according to embodiments of the present invention.

For further explanation, FIG. 6 sets forth a diagram of a further example linear regulator with two feedback loops, according to embodiments of the present invention. The linear regulator (501) of FIG. 6 includes the same components and configuration as the linear regulator (501) of FIG. 5 with the exception that the inputs (570, 571) of the high gain, low bandwidth second amplifier (504) are coupled to different components of the linear regulator (501). In the example of FIG. 6, the inverting input (571) of second amplifier (504) is coupled to the output (576) of the second transistor (508) and the non-inverting input (570) of second amplifier (504) is coupled to the output (575) of the first transistor (506). The high gain, low bandwidth second amplifier (504) of FIG. 6 is driven by the voltage level at the output (575) of the first transistor (506) and the voltage level of the output (576) of the second transistor (508).

That is, the input to the second amplifier (504) in FIG. 6 is no longer the voltage difference between the feedback signal (591) and reference voltage (550), rather it is the voltage difference between outputs (575, 576)) of the first transistor (506) and second transistor (508). In both embodiments, the intent of the second feedback loop (505) is to reduce the voltage difference between the voltage at the output (575) of the first transistor (506) and the voltage at the output (576) of the second transistor (508). Recall that the extent to which the second feedback loop (505) locks the output voltage (587) of the linear regulator (501) to the reference voltage (550) in order to reduce the output regulated error is determined by the voltage difference between outputs (575, 576) of the first transistor (506) and second transistor (508) divided by the voltage gain of the first amplifier (502).

Figure 7:
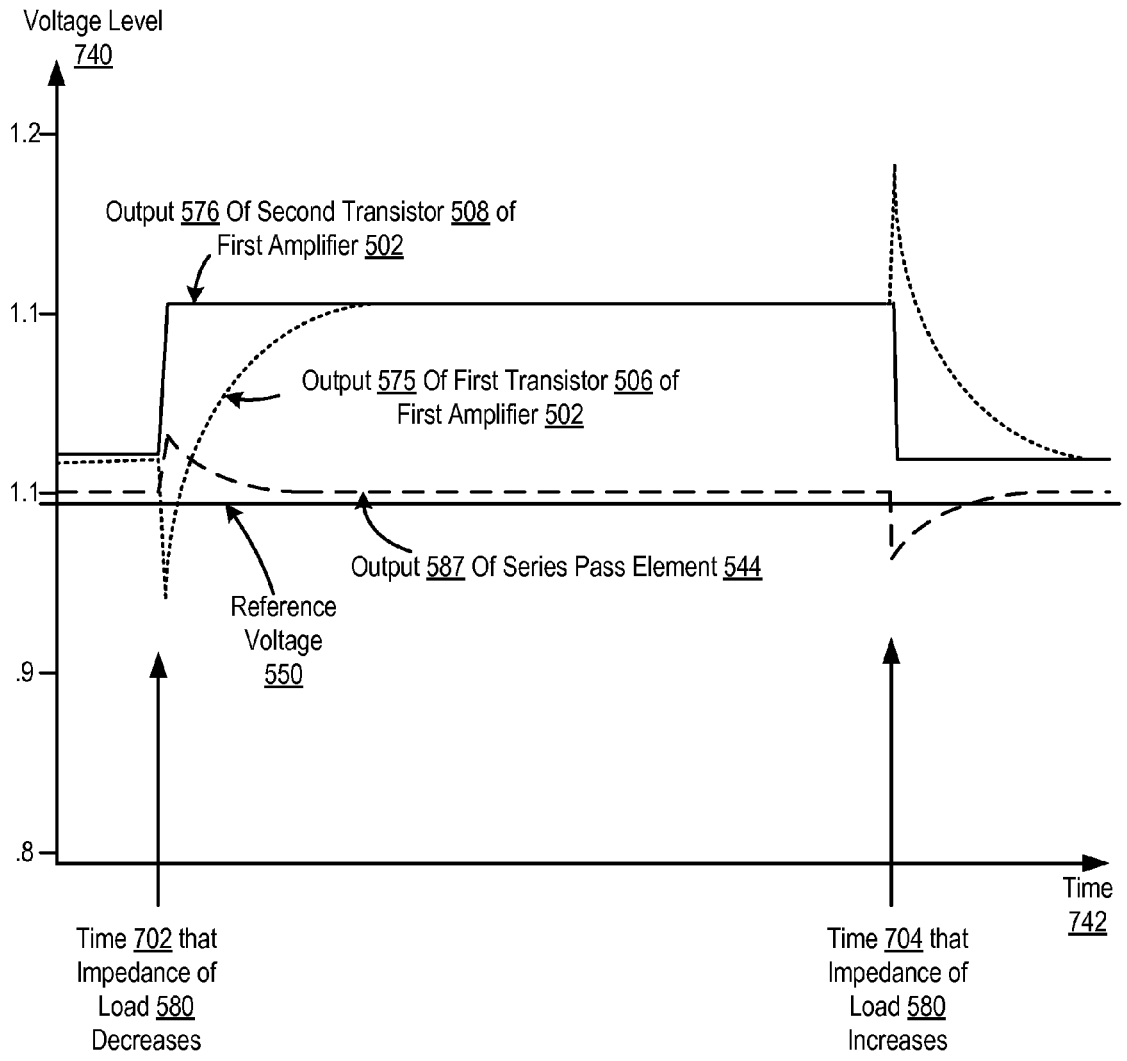
FIG. 7 sets forth a timing diagram illustrating the voltage levels at different points of the linear regulator of FIG. 5 during operation of the power supply according to embodiments of the present invention.

FIG. 7 sets forth a timing diagram illustrating operation of the linear regulator (501) of FIG. 5 according to embodiments of the present invention. The timing diagram illustrates changes in voltage level (740) over time (742) at different test points on the linear regulator (501) of FIG. 5 in response to two load changes generating two different feedback signals. The test points are illustrated on FIGS. 5 and 6, so that FIG. 7 is explained here using reference numbers from all three FIGS. 5, 6, and 7. In response to a first load change at time (702), when the current demand by the load (580) decreases and the voltage level at the output (587) of the power output transistor (544) increases, the first feedback loop (507) responds to the change in the voltage level at the series pass element (544). The response of the first feedback loop (507) includes quickly decreasing the voltage level at the output (575) of the first transistor (506) of the first amplifier (502) while simultaneously increasing the voltage level at the output (576) of the second transistor (508) of the first amplifier (502). As a result, the control input (574) of series pass element (586) increases, whereby the current delivered by the output (587) of series pass element (544) decreases to quickly match the load current demand. Note, however, that because the voltages at outputs (575, 576) of the first transistor (506) and second transistor (508) initially move in different directions, the regulated output voltage (587) voltage deviates from the target reference voltage (550).

In response to the change in the voltage level at the output (587) of series pass element (544), the second feedback loop (505) also responds, more slowly but with high gain. The response of the second feedback loop (505) includes changing the control output (572) of the second amplifier (505) which reduces current flow in the biasing transistor (542). The first feedback loop (507) holds the voltage output (576) of the second transistor (508) constant during this time by maintaining constant current flow in the load resistor (522). The reduction in current flow of the biasing transistor (542) reduces the current flow through the load resistor (520) by an equal amount, thereby reducing the voltage drop of the load resistor (520) and increasing the voltage output (575) of the first transistor (506) to match the voltage output (576) of the second transistor (508). Because the voltages of outputs (575, 576) of the first transistor (506) and the second transistor (508) are now effectively the same voltage potential, the output voltage (587) and the reference voltage (550) are also effectively the same potential, and hence the regulated voltage error is low.

In response to a second load change at time (704), when the current demand by the load (580) increases and the voltage level at the output (587) of the series pass element (544) decreases, the first feedback loop (507) responds to the change in the voltage level at the series pass element (544). The response of the first feedback loop (507) includes quickly increasing the voltage level at the output (575) of the first transistor (506) of the first amplifier (502) while simultaneously decreasing the voltage level at the output (576) of the second transistor (508) of the first amplifier (502). As a result, the control input (574) of series pass element (586) decreases, whereby the current delivered by the output (587) of the series pass element (544) increases to quickly match the load current demand. Note again, that because the voltages at outputs (575, 576) of the first transistor (506) and second transistor (508) initially move in different directions, the regulated output voltage (587) deviates from the target reference voltage (550).

In response to the change in the voltage level at the output (587) of the series pass element (544), the second feedback loop (505) again responds, more slowly but with high gain. The response of the second feedback loop (505) includes changing the control output (572) of the second amplifier (505) which increases current flow in the biasing transistor (542). The first feedback loop (507) holds the voltage output (576) of the second transistor (508) constant during this time by maintaining constant current flow in the load resistor (522). The increase in current flow of the biasing transistor (542) increases the current flow through the load resistor (520) by an equal amount, thereby increasing the voltage drop of the load resistor (520) and decreasing the voltage output (575) of the first transistor (506) to match the voltage output (576) of the second transistor (508). Because the voltages of outputs (575, 576) of the first transistor (506) and the second transistor (508) are now effectively the same voltage potential, the output voltage (587) and the reference voltage (550) are also effectively the same potential, and hence the regulated voltage error is low.

Figure 8:
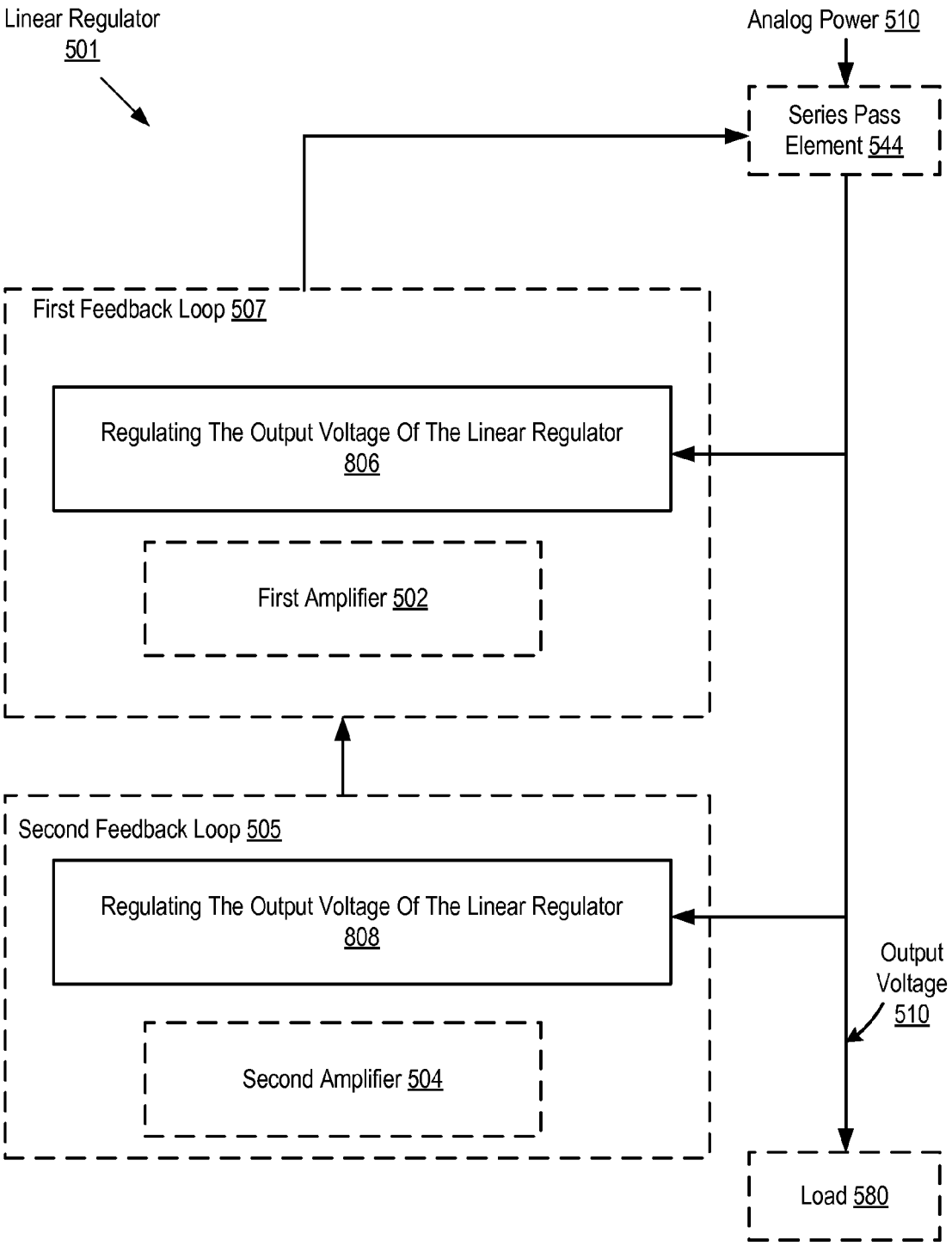
FIG. 8 sets forth a flow chart illustrating an example method of regulating a supply voltage according to embodiments of the present invention.

For further explanation, FIG. 8 sets forth an example method of regulating a supply voltage according to embodiments of the present invention. The method of FIG. 8 is a method of operation effected with and upon linear regulators such as those illustrated and explained above with reference to FIGS. 5 and 6. The method of FIG. 5 therefore is explained here with reference both to FIG. 8 and also to FIGS. 5 and 6, using reference numbers from all three Figures.

The method of FIG. 8 includes regulating (806), by a first feedback loop (507) of a linear regulator (501), the output voltage (510) of the linear regulator (501). In the example of FIG. 8, the first feedback loop (507) includes a first amplifier (502) characterized by an output impedance which is significantly reduced in order to maximize the bandwidth of the first feedback loop (507) when driving the capacitance of a control input of a series pass element (544).

The method of FIG. 8 also includes regulating (808), by a second feedback loop (505) of the linear regulator (501), the output voltage of the linear regulator (501). In the example of FIG. 8, the second feedback loop (505) is characterized by a second bandwidth and a second gain and includes a second amplifier (504) that controls the current in the first amplifier (502) in the first feedback loop (507).

In the example of FIG. 8, the first feedback loop (507), the second feedback loop (505), and the series pass element (544) act together within the linear regular (501) to regulate a voltage level at the output of the series pass element (544). Regulating the voltage level at the output of the series pass element (544) includes substantially matching the voltage level at the output of the series pass element (544) to a reference voltage level (550).

In the example of FIG. 8, when a current demand of the load (580) changes, the first amplifier (502) of the first feedback loop (507) acts to quickly change a control input of the series pass element (544) in order to change the current level being supplied to the load (580).

In the example of FIG. 8, the second amplifier (504) of the second feedback loop (507) controls the current in the first amplifier (502) in the first feedback loop (507) to act to correct gain error resulting from the first gain in the first feedback loop (507).

In the example of FIG. 8, the first amplifier (502) of the first feedback loop (507) drives a control signal through the gate capacitance of the series pass element (544). The output of the series pass element (544) provides a regulated voltage level to the load (580).

The first amplifier (502) of the first feedback loop (507) may be a differential amplifier with two outputs. The second amplifier (504) drives a control signal through an input of the first amplifier (502) to force the two outputs of the first amplifier (502) to have effectively the same voltage potential. The first amplifier (502) may be a low gain, high bandwidth amplifier and the second amplifier (504) may be a high gain, low bandwidth amplifier.

It will be understood from the foregoing description that modifications and changes may be made in various embodiments of the present invention without departing from its true spirit. The descriptions in this specification are for purposes of illustration only and are not to be construed in a limiting sense. The scope of the present invention is limited only by the language of the following claims.

What is claimed is:

1. A linear regulator comprising:

a first feedback loop characterized by a first bandwidth and a first gain, the first feedback loop including a first amplifier characterized by an output impedance which is significantly reduced in order to maximize the bandwidth of the first feedback loop when driving the capacitance of a control input of a series pass element; and a second feedback loop characterized by a second bandwidth and a second gain, the second feedback loop including a second amplifier that controls the current in the first amplifier in the first feedback loop, wherein the first amplifier and the second amplifier receive a same reference voltage level, and wherein the second amplifier of the second feedback loop controlling the current in the first amplifier in the first feedback loop acts to correct gain error resulting from the first gain in the first feedback loop, wherein, the first amplifier is a low gain, high bandwidth amplifier and the second amplifier is a high gain, low bandwidth amplifier.

2. The linear regulator of claim 1 wherein the first feedback loop, the second feedback loop, and the series pass element act together within the linear regular to regulate a voltage level at the output of the series pass element.

3. The linear regulator of claim 1 wherein the first feedback loop, the second feedback loop, and the series pass element act together within the linear regular to regulate a voltage level at the output of the series pass element, wherein the voltage level at the output of the series pass element is regulated to substantially match the reference voltage level.

4. The linear regulator of claim 1 wherein when a current demand of a load connected to the linear regulator changes, the first amplifier of the first feedback loop acts to quickly change a control input of the series pass element in order to change the current level being supplied to the load.

5. The linear regulator of claim 1 wherein the first amplifier drives a control signal through the gate capacitance of the series pass element, the output of the series pass element providing a regulated voltage level to a load connected to the linear regulator.

6. The linear regulator of claim 1 wherein the first amplifier is a differential amplifier with two outputs, wherein the second amplifier drives a control signal through an input of the first amplifier to force the two outputs of the first amplifier to have effectively the same voltage potential.

7. A method of regulating a supply voltage, the method comprising:

regulating, by a first feedback loop of a linear regulator, the output voltage of the linear regulator, the first feedback loop including a first amplifier characterized by an output impedance which is significantly reduced in order to maximize the bandwidth of the first feedback loop when driving the capacitance of a control input of a series pass element; and regulating, by a second feedback loop of the linear regulator, the output voltage of the linear regulator, the second feedback loop characterized by a second bandwidth and a second gain, the second feedback loop including a second amplifier that controls the current in the first amplifier in the first feedback loop, wherein the first amplifier and the second amplifier receive a same reference voltage level, and wherein the second amplifier of the second feedback loop controlling the current in the first amplifier in the first feedback loop acts to correct gain error resulting from the first gain in the first feedback loop, wherein, the first amplifier is a low gain, high bandwidth amplifier and the second amplifier is a high gain, low bandwidth amplifier.

8. The method of claim 7 wherein the first feedback loop, the second feedback loop, and the series pass element act together within the linear regular to regulate a voltage level at the output of the series pass element.

9. The method of claim 7 wherein the first feedback loop, the second feedback loop, and the series pass element act together within the linear regular to regulate a voltage level at the output of the series pass element, wherein the voltage level at the output of the series pass element is regulated to substantially match the reference voltage level.

10. The method of claim 7 wherein when a current demand of a load connected to the linear regulator changes, the first amplifier of the first feedback loop acts to quickly change a control input of the series pass element in order to change the current level being supplied to the load.

11. The method of claim 7 wherein the first amplifier drives a control signal through the gate capacitance of the series pass element, the output of the series pass element providing a regulated voltage level to the capacitive load.

12. The method of claim 7 wherein the first amplifier is a differential amplifier with two outputs, wherein the second amplifier drives a control signal through an input of the first amplifier to force the two outputs of the first amplifier to have effectively the same voltage potential.

* * * * *